US006182647B1

(12) United States Patent
Hori et al.

(10) Patent No.: US 6,182,647 B1
(45) Date of Patent: Feb. 6, 2001

(54) FUEL INJECTION CONTROL APPARATUS AND FUEL INJECTION METHOD

(75) Inventors: Toshio Hori; Takeshi Atago, both of Hitachinaka (JP)

(73) Assignee: Hitachi, Ltd., Tokyo (JP)

( * ) Notice: Under 35 U.S.C. 154(b), the term of this patent shall be extended for 0 days.

(21) Appl. No.: 09/220,799

(22) Filed: Dec. 28, 1998

(30) Foreign Application Priority Data

Dec. 25, 1997 (JP) ..... 9-357691

(51) Int. Cl.[7] ..... F02D 41/14
(52) U.S. Cl. ..... 123/674; 123/679
(58) Field of Search ..... 123/478, 490, 123/672, 674, 679

(56) References Cited

U.S. PATENT DOCUMENTS 4,532,907 * 8/1985 Buglione et al. ..... 123/490
5,791,321 * 8/1998 Kondoh ..... 123/698

FOREIGN PATENT DOCUMENTS 9-209803 8/1997 (JP) .

* cited by examiner

*Primary Examiner*—Tony M. Argenbright
(74) *Attorney, Agent, or Firm*—Evenson, McKeown, Edwards & Lenahan, P.L.L.C.

(57) ABSTRACT

When a pulse width limitation control is carried out, an air-fuel ratio feedback correction control such as $O_2$ feedback or an A/F (air-fuel ratio) learning correction control is prohibited or limited. When the pulse width limitation control is carried out, various kinds of factors for carrying out a basic injection amount are made a prohibition condition or a limitation condition, and when other operation conditions arise, the operability is not damaged.

6 Claims, 9 Drawing Sheets

FUEL INJECTION CONTROL APPARATUS AND FUEL INJECTION METHOD

BACKGROUND OF THE INVENTION

The present invention relates to a fuel injection control apparatus of an internal combustion engine and a fuel injection method of an internal combustion engine.

Up to now, by carrying out a fuel control in which a desirable injection characteristic of a fuel injector can be obtained, a fuel injection control apparatus having a wide range linear characteristic area has been proposed. For example, Japanese patent application laid-open No. Hei 9-209803 discloses, in a fuel injection control apparatus constituted by including an operation condition detection means for defecting an engine operation condition, a fuel injection amount establishment means for establishing a fuel injection mount to the engine according to the detected engine operation condition, and a fuel injection control means for carrying out a fuel injection control according to the established fuel injection amount through a fuel injector. A fuel injection control apparatus for use in an internal combustion engine is characterized in that the fuel control apparatus is constituted including a correction amount establishment means for establishing a correction amount to have a desirable injection characteristic of the fuel injection amount from the fuel injector, and a fuel injection amount correction means for correcting the fuel injection mount is established by the fuel injection amount establishment means according to the established correction amount.

The above stated desirable injection characteristic is a relationship between a drive signal to the fuel injector and the fuel injection amount having the linear characteristic in which a substantially constant inclination extending over at substantially whole area.

In an engine such a lean burn engine and a cylinder-in injection gasoline engine, at a small area of the fuel injection amount, an actual fuel injection amount against a control value becomes small, namely there happens that a direction of a fuel pulse width disagrees with a direction of an increase area of the fuel amount. With the above stated reasons, an unstable use area exists in the small area of the fuel injection amount, there is a concern about inviting aggravation of the operability and the exhaust gas property. With these reasons, in the conventional example stated above, it has been proposed that the correction amount is determined to obtain that the relationship between the drive signal to the fuel injector and the fuel injection amount has the linear characteristic having a substantially constant inclination extending substantially over the whole area.

However, when the above stated linear characteristic control is carried out or not carried out, in the area where the fuel injection amount becomes further small, it is impossible to carry out the correspondence between the fuel injection amount and the fuel injection pulse width. This area is positioned as the use impossible area and the pulse width limitation is carried out.

SUMMARY OF THE INVENTION

An object according to the present invention to provide a fuel injection control apparatus and a fuel injection method wherein when the above stated pulse width limitation control is carried out, the fuel injection control can be carried out suitably, and by excepting the factors for giving the affects to the pulse width control limitation, and when it moves to other operation conditions, the operability is not damaged according to the excess operational conditions such as an over lean condition.

According to the present invention, the control where the fuel pulse width limitation is carried out, an air-fuel ratio feedback correction used in the execution of fuel pulse width or A/F (air-fuel ratio) learning correction are carried out, namely it has a characteristic when the limitation is carried out. As the means for limitation, it can employ an open control. As the fuel width limitation, there are a fuel width lower limitation and a fuel width upper limitation, however in the present invention, it is effective when the fuel width lower limitation is employed.

Herein, the concept about the air-fuel ratio feedback includes $O_2$ feedback.

More concretely, the present invention will provide following apparatuses and methods.

In a fuel injection control apparatus having an operation condition detection means for detecting an engine operation condition, a fuel injection amount establishment means for establishing a fuel injection amount to an engine according to said detected engine operation condition, and an air-fuel ratio feedback correction means for correcting said fuel injection pulse width according to an air-fuel ratio feedback correction, the fuel injection control apparatus further includes a pulse width lower limitation establishment means for establishing a pulse width lower limitation value, and a control means for carrying out a control which limits a pulse width correction alternation command according to said air-fuel ratio feedback correction means, as to said fuel injection pulse width which is affected to a correction according to said air-fuel ratio feedback correction, when said pulse width lower limitation value control is carried out.

In a fuel injection control apparatus having an operation condition detection means for detecting an engine operation condition which includes a control means to open control an air-fuel ratio feedback correction means, a fuel injection amount establishment means for establishing a fuel injection amount to an engine according to said detected engine operation condition, and an air-fuel ratio feedback correction means for correcting said fuel injection pulse width according to an air-fuel ratio feedback correction, the fuel injection control apparatus further includes a pulse width limitation establishment means for establishing a pulse width limitation value, and a control means for carrying out a control which limits a pulse width correction alternation command according to said air-fuel ratio feedback correction means, under a condition in which said pulse width limitation is carried out.

In a fuel injection control apparatus having an operation condition detection means for detecting an engine operation condition, a fuel injection amount establishment means for establishing a fuel injection amount to an engine according to said detected engine operation condition, an air-fuel ratio feedback correction means for correcting said fuel injection pulse width according to an air-fuel feedback ratio correction, and an A/F (air-fuel) learning correction means for A/F learning correcting said fuel injection width according to the A/F leaning, the fuel injection control apparatus further includes a pulse width lower limitation establishment means for establishing a pulse width lower limitation value, and a correction width limitation means for limiting the correction, when a calculated fuel injection pulse width according to said air-fuel ratio feedback correction and said A/F learning correction exceeds over said pulse width lower limitation value.

In a fuel injection control apparatus having an operation condition detection means for detecting an engine operation condition, a fuel injection amount establishment means for establishing a fuel injection amount to an engine according to said detected engine operation condition, an injection pulse width establishment means for establishing a fuel injection width according to said established fuel injection amount, and an A/F (an air-fuel ratio) learning correction means for A/F learning correcting said fuel injection pulse width according to an A/F learning, the fuel injection control apparatus further includes a pulse width limitation establishment means for establishing a pulse width limitation value, and means for limiting a renewal of the A/F learning, when said fuel injection width affected and calculated according to said correction of said A/F learning correction means exceeds over said pulse width lower limitation value.

In a fuel injection method for detecting an engine operation condition, for establishing a fuel injection amount to said engine according to said detected operation condition, for establishing a fuel injection pulse width according to said established fuel injection amount, and for carrying out a fuel injection control according to said established fuel injection pulse, the fuel injection method comprising a first operation mode for limiting said fuel injection pulse width, and a second operation mode for operating to reopen an air-fuel ratio feedback correction and an A/F learning correction, by using an air-fuel ratio feedback correction coefficient or an A/F learning correction coefficient which are limited at said first operation mode.

DESCRIPTION OF THE INVENTION

Hereinafter, a fuel injection control apparatus and a fuel injection method of one embodiment to which the present invention is adopted will be explained referring to drawings.

Figure 1:
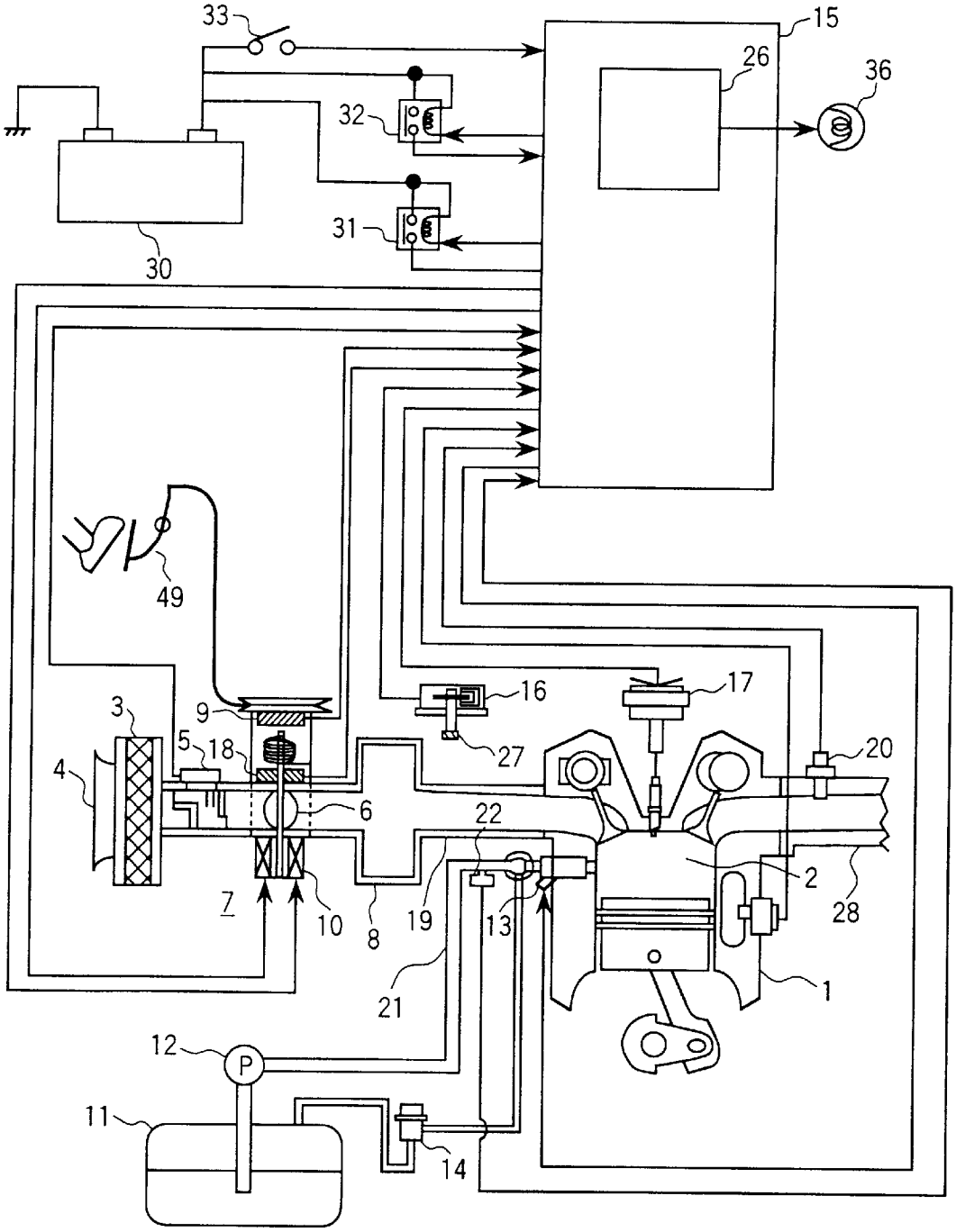
FIG. 1 is a schematic view showing a fuel injection control apparatus to which the present invention is adopted.

FIG. 1 shows one example of an engine system on which a fuel injection control apparatus according to the present invention is adopted. In FIG. 1, the air to be inhaled in an internal combustion engine 1 is taken in from an inlet port 4 of an air cleaner 3 and further passes through a throttle valve apparatus 7 in which a throttle valve 6 for controlling the intake air amount is installed and further the air enters into a collector 8. The throttle valve 6 is connected to a motor 10 and by driving the motor 10 the throttle valve 5 is operated. By operating the throttle valve 5, the inhale air amount is controlled. The intake air which reaches to the collector 8 is distributed to a respective inhale air conduit 19, this intake air conduit 19 is connected to a respective cylinders 2 of the engine 1 and led to the cylinder 2.

On the other hand, the fuel such as the gasoline is sucked from a fuel tank 11 through a fuel pump 12 and after the pressurization the fuel is supplied to a fuel system 21 in which a fuel injector (an injector) 13 and a variable fuel pressure regulator 14 are carried out with the piping system. And, this fuel system is adjusted to have a predetermined pressure by the above stated variable fuel pressure regulator 14 and the fuel is injected to the cylinder 2 from the fuel injector 13 which opens a fuel injection port against the respective cylinder 2. Further, from an air flow meter 5 a signal for expressing the intake air flow amount is outputted and is inputted to a control unit 15.

Further, to the above stated throttle valve apparatus 7 a throttle valve sensor 18 which detects an opening degree of the throttle valve 6 is installed, and an output thereof is also inputted to the control unit 15.

Next, a crank angle sensor 16 is driven rotatively through a cam shaft 28 and output a signal for expressing a rotational position of a crank shaft. This signal is inputted also to the control unit 15.

An A/F (air-fuel ratio) sensor 20 is provided on an exhaust gas conduit 28 and detects and output an actual operation air-fuel ratio and a signal thereof is also inputted to the control unit 15.

An acceleration pedal sensor 9 is provided integrally to the throttle valve apparatus 7 and is connected to an acceleration pedal 49 and this sensor detects and output an operation amount of the acceleration pedal 49 by operated a driver and a signal thereof is also inputted to the control unit 15.

The above stated control unit 15 has a processing means 26 and is taken in the signals as input signals such as the above stated crank angle signal and the signals from the various kinds sensors which detect the operation conditions of the engine such as the acceleration pedal opening degree sensor and executes a predetermined execution. The various kinds control signals calculated as the execution results are outputted, and predetermined control signals are outputted to the above stated fuel injector 13, an ignition coil 17 and the motor 5 for carrying out the operation of the throttle valve 5 and as a result the fuel supply control, the ignition timing control, and the inhale air amount control are carried out.

Between a power supply (a battery) 30 and the control unit 15, a motor driver relay means 31, a control unit relay means 32 and an ignition switch means 33 are provided. Numeral 35 denotes various kinds warning lamps.

Since the above stated construction is well known, it will not require further explanation. A fuel pressure sensor 22 is provided adjacently to the variable fuel pressure regulator 14 which is provided on the fuel system, and a signal thereof is inputted also to the control unit 15.

Figure 2:
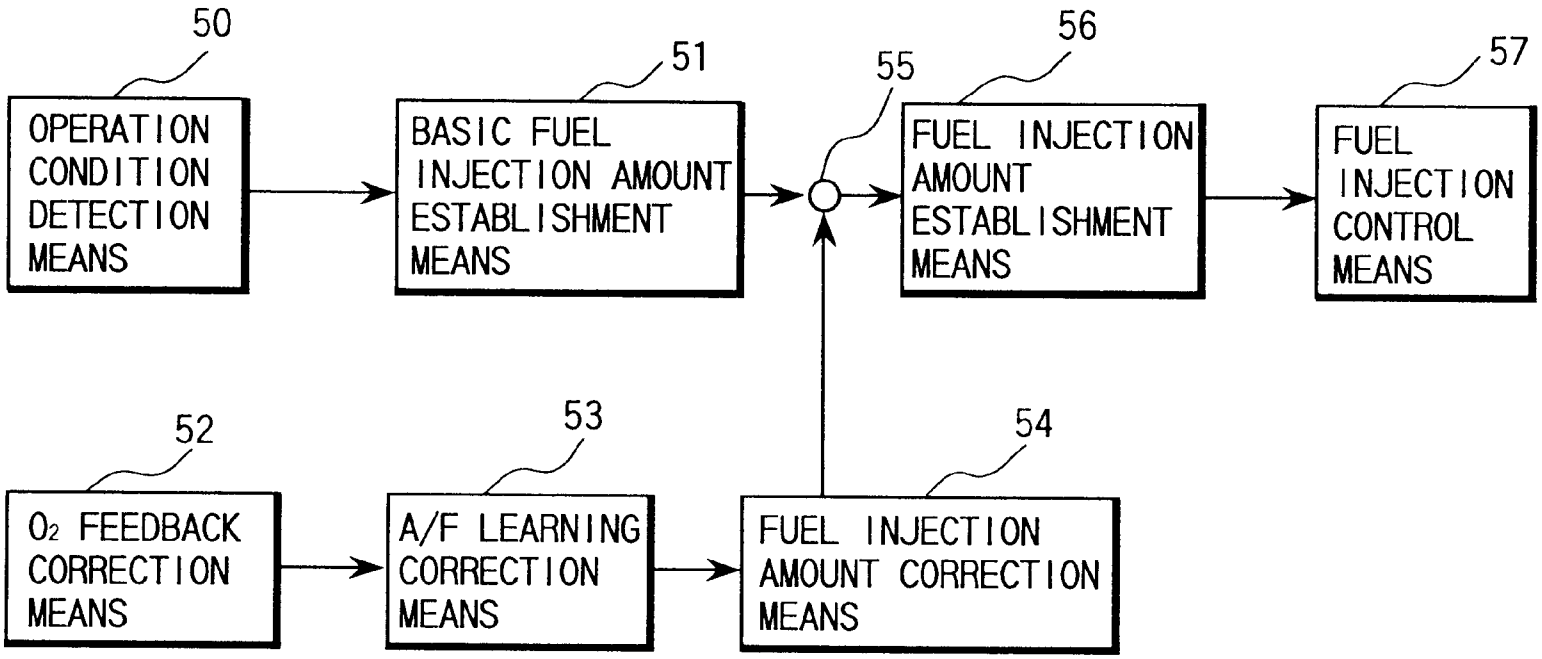
FIG. 2 is a block diagram showing a characteristic view of the fuel injection control apparatus.

FIG. 2 shows a block diagram relating to the fuel injection control apparatus of one embodiment according to the present invention. The fuel injection control apparatus of this embodiment comprises a detection means 50 for detecting the operation conditions such as the engine revolution number and the engine inhale air amount etc., a basic fuel injection amount establishment means 51, an $O_2$ feedback correction means 52 being as one of the air-fuel ratio feedback, an A/F learning correction means 53, an addition means 55 for adding a correction coefficient according to these correction means to the basic fuel injection amount, a fuel injection amount establishment means 56 for establishing the fuel injection amount and for establishing the fuel pulse width, and a fuel injection control means 57 for carrying out the correction limitation control to control to not carry out $O_2$ feedback correction and A/F learning correction, when the fuel injection control according to the pulse width, the fuel pulse width limitation control, and the fuel pulse width control are carried out. Other control means will be added suitably and will be permitted naturally.

Figure 3:
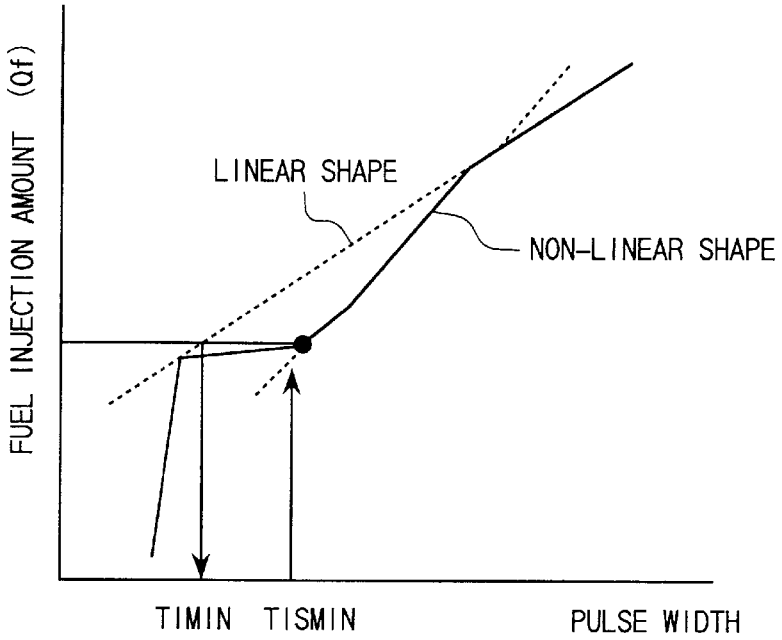
FIG. 3 is a graph of the fuel injection control apparatus of one embodiment according to the present invention.

FIG. 3 shows a relationship between the fuel injection amount Qf and the pulse width in a case where the fuel injection amount is small. In an area where the fuel injection amount is large, the fuel injection amount and the pulse width have a linear shape characteristic; however in a case where the fuel injection amount becomes small, it has a non-linear shape characteristic. In common, the specifying of the non-linear shape is defined, as shown in figure, the actual minimum pulse width is converted to a supposition point under the linear shape relationship, at TIMIN the pulse width is calculated. Namely, the pulse width on the linear shape characteristic of the same flow amount with TISMIN is requested and it is made TIMIN. In less than TISMIN, since it is impossible to carry out the fuel supply according to the minimum pulse performance, accordingly the limitation of the pulse width is carried out.

Figure 4:
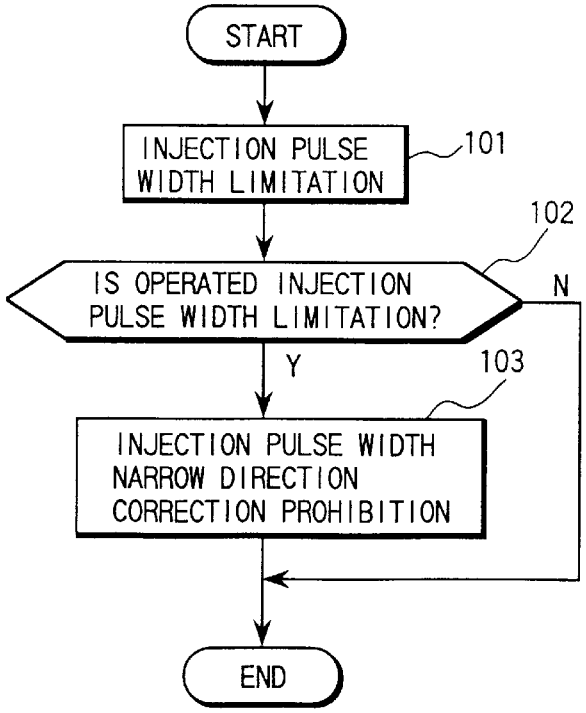
FIG. 4 is a flow chart showing a concept of the fuel injection control apparatus according to the present invention.

FIG. 4 shows the concept of the fuel injection control apparatus and the fuel injection method of the present invention. The injection pulse width limitation is established (a step 101) and it is judged that whether the injection pulse width limitation operates or not (a step 102) and in a case of "YES", the injection pulse width narrow direction correction prohibition is carried out (a step 103).

Figure 5:
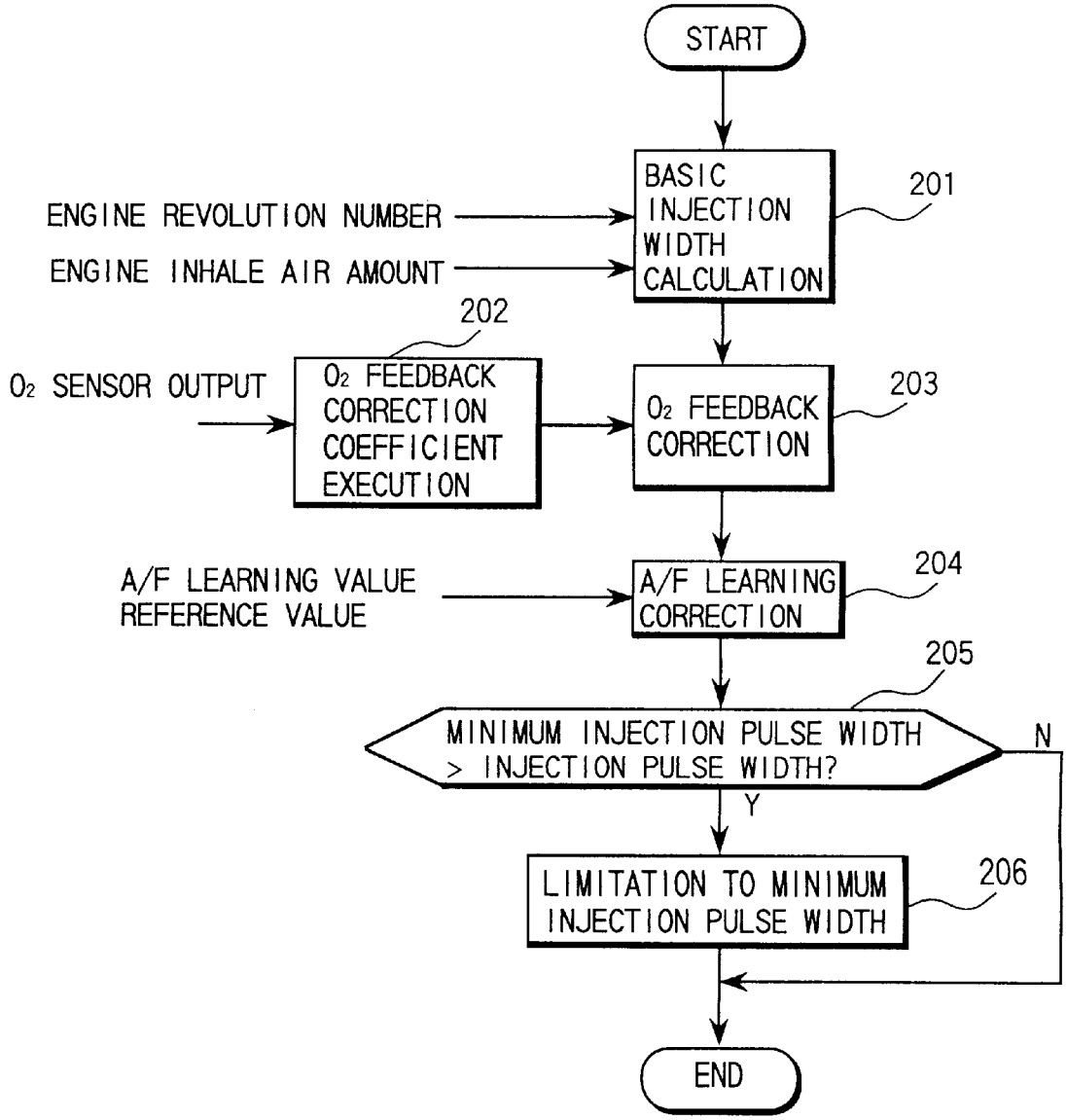
FIG. 5 is a flow chart showing the conventionally used fuel injection control apparatus.

FIG. 5 shows the flow chart for carrying out the conventional $O_2$ feedback correction and A/F learning correction. The operation conditions such as the engine revolution number and the engine inhale air amount etc. are detected and according to the condition amounts the basic injection pulse width calculation is carried out (a step 201). According to $O_2$ sensor output, $O_2$ feedback correction coefficient execution is carried out (a step 202) and according to this result $O_2$ feedback correction is carried out (a step 203). Using A/F learning value reference value, A/F learning correction is carried out (a step 204). Accordingly, the basic injection pulse width is corrected and the injection pulse width is calculated. This injection pulse width is compared with the advanced established minimum injection pulse width and it is judged that whether the minimum pulse width is larger than the injection pulse width or not (a step 205). In a case of "YES", the injection pulse width is limited to the minimum injection pulse width (a step 206). Including this minimum injection pulse, the injection pulse having the establishment of the limitation value is called as the limitation injection pulse, and further the lower thereof is called as the lower limitation and the upper thereof is called as the upper limitation.

Figure 6:
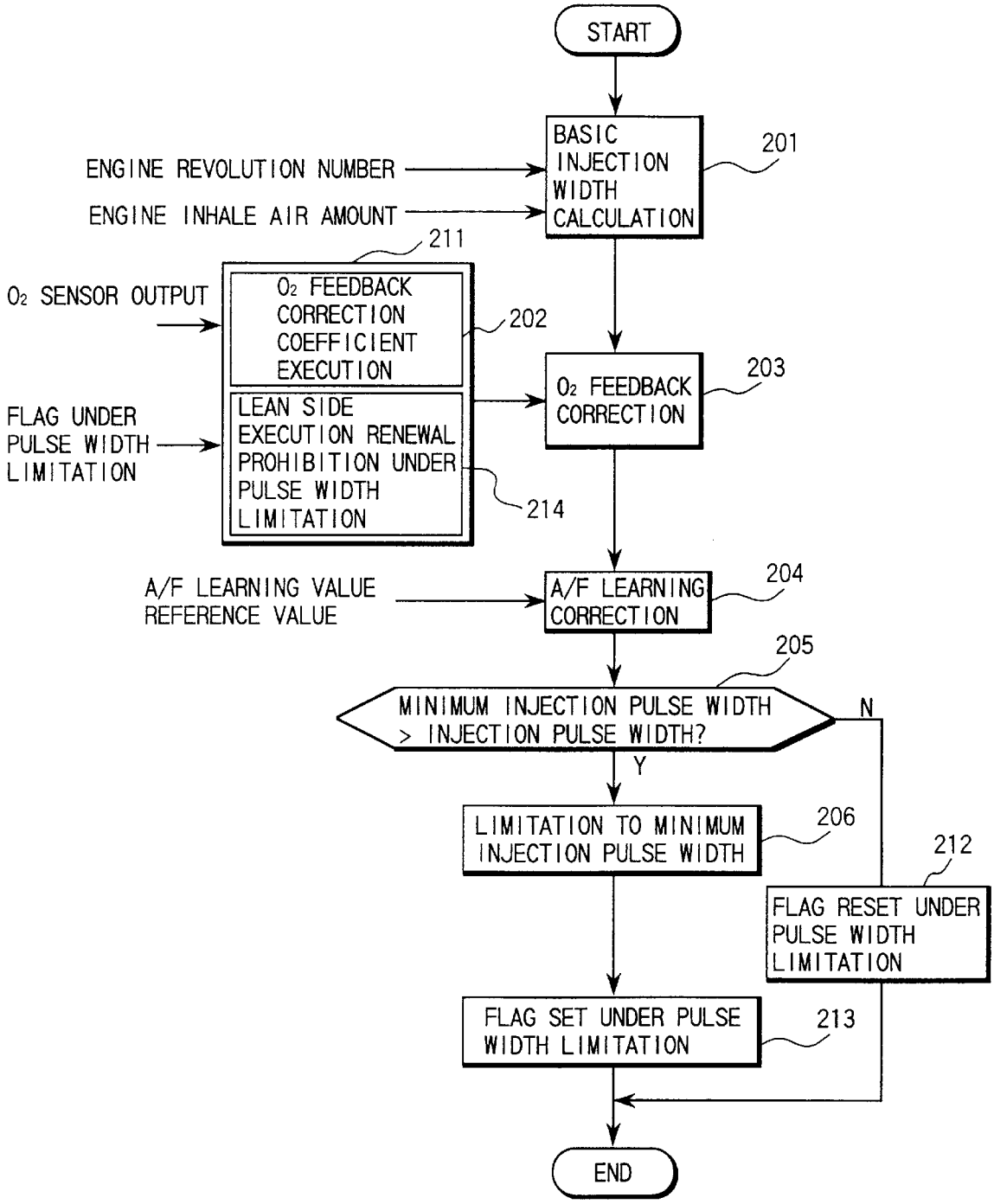
FIG. 6 is a flow chart of the fuel injection control apparatus of one embodiment according to the present invention.

The flow chart of the fuel injection control apparatus of the embodiment according to the present invention is shown in FIG. 6. The elements which are the same as in FIG. 5 are denoted by the same reference numerals. In a step 206, when the limitation control for limiting to the minimum injection pulse width, the flag reset under the pulse width limitation is carried out (a step 213). Further, in a step 205, it is judged that whether the minimum injection pulse width is larger than the injection pulse width or not, and in a case of "NO", the flag reset under the pulse width limitation is carried out (a step 212).

When the flag reset under the pulse width limitation is carried out, with respect to $O_2$ feedback, during under the pulse limitation, the execution renewal prohibition at the lean side is carried out (a step 214). The above stated step 202 and the step 214 relate to the correction coefficient executions and it is called as the correction coefficient execution step 211. Herein, the execution renewal prohibition can limit and/or prohibit literally the execution renewal or can be attained by making $O_2$ feedback control from the close control to the open control.

Figure 7A:
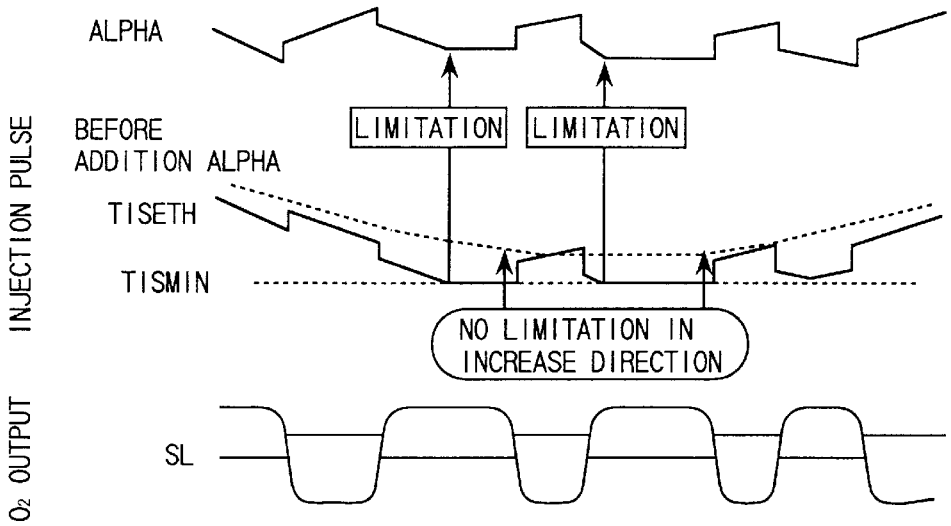
FIG. 7A is another flow chart of the fuel injection control apparatus of one embodiment according to the present invention.
Figure 7B:
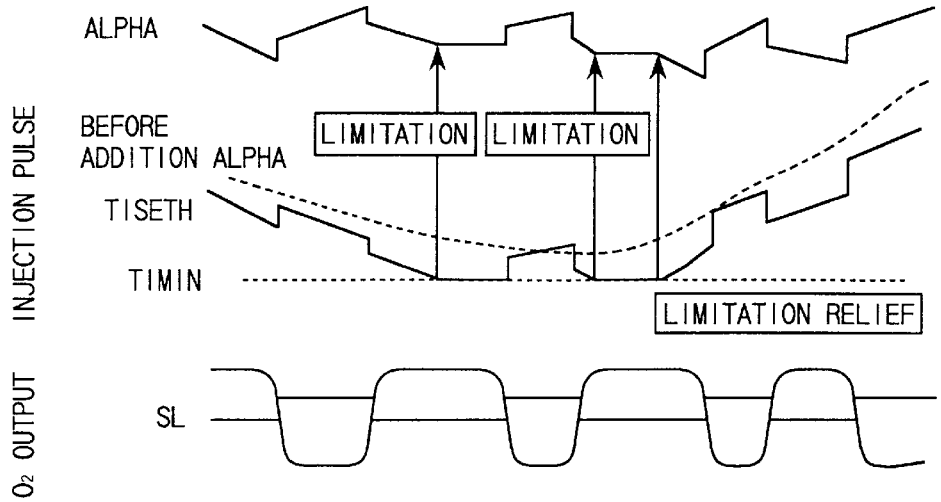
FIG. 7B is a further flow chart of the fuel injection control apparatus of one embodiment according to the present invention.

FIG. 7A and FIG. 7B shows the time charts showing the relationship between the injection pulse, $O_2$ (sensor) output, and the pulse width limitation. FIG. 7A shows a case where at the high rotation idling condition, the injection fuel pulse width reduces and moves toward the lean side, and the pulse width limitation (TISMIN) operates, the injection fuel slow increase increases toward the rich side, and it separates TIMIN limitation. $O_2$ feedback correction value in which the correction is not performed according to $O_2$ feedback is expressed by "ALPHA", and the chart before the addition of ALPHA is expressed by "before addition ALPHA", and the established fuel injection pulse width is expressed by "TIESETH". The slice level of $O_2$ output is expressed by "SL". As shown in figure, when the pulse width is limited according to the pulse width limitation TISMIN, $O_2$ feedback correction is prohibited, namely is limited. The limitation is not carried out to the increase direction toward ALPHA rich side. In this case, ALPHA is limited, however according to the delay in response in a short time it reverses toward the rich side.

To sum up, when TISMIN limitation operates, in accordance with a next ALPHA calculation timing the reduction of ALPHA is prohibited and the fuel injection pulse is calculated and as a result the move of ALPHA is limited. The limitation toward the reduction direction of ALPHA is limited only to the motion according to the close loop; however, the limitation is not limited the behavior of the open loop time.

FIG. 7B shows that by the rapid fuel injection pulse width increase, ALPHA lean side correction becomes the limitation relief at TIMIN.

Figure 8:
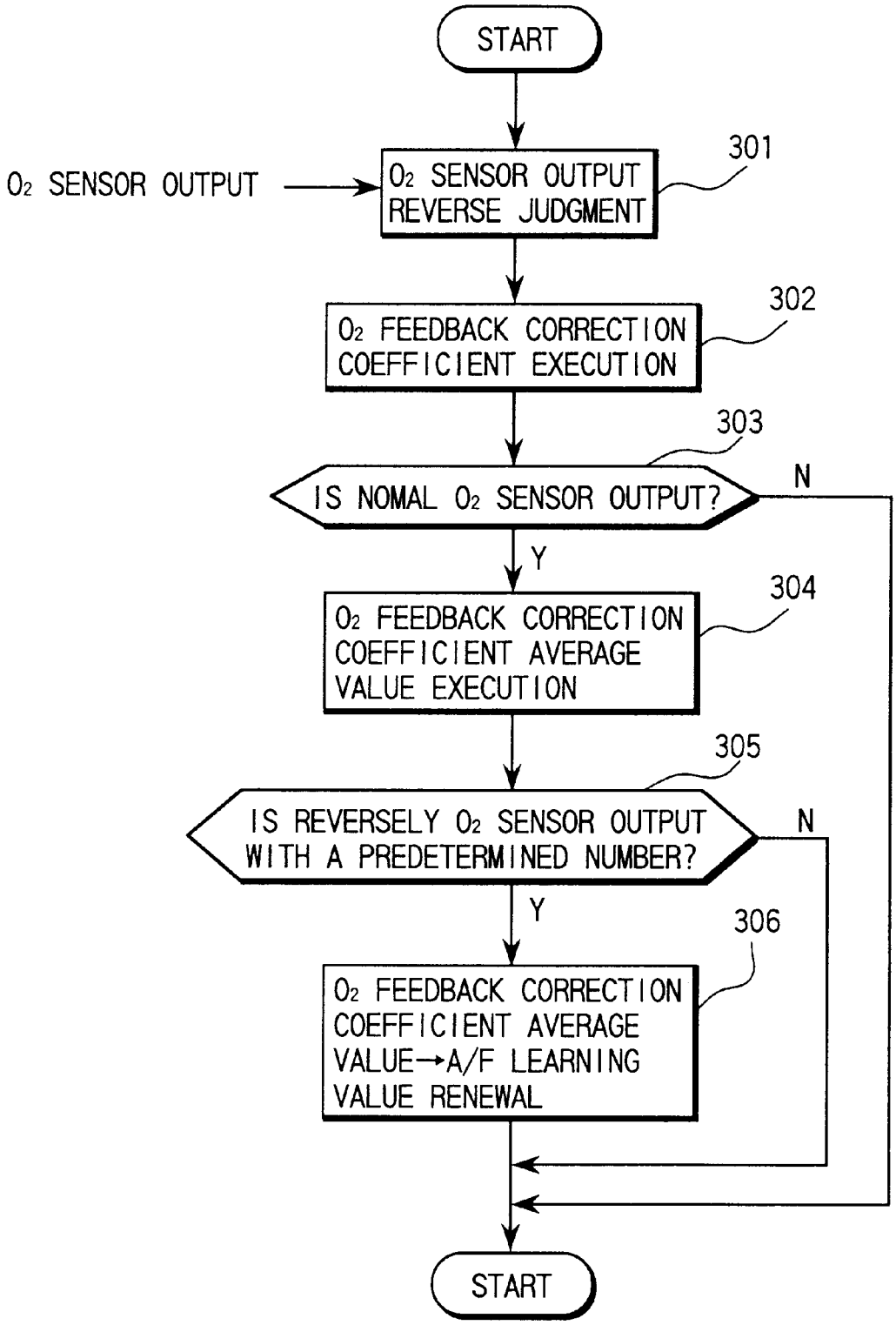
FIG. 8 is a flow chart showing the conventionally used fuel injection control apparatus.

FIG. 8 shows the flow chart of the ordinary A/F learning value execution. According to $O_2$ sensor output, $O_2$ sensor output reversal judgment is carried out (a step 301) and $O_2$ feedback correction coefficient execution is carried out (a step 302). Next, it is judged that whether $O_2$ sensor output is normal or not, and in a case of "YES", $O_2$ feedback correction coefficient average value execution is carried out (a step 304) and it is judged that whether $O_2$ sensor output is reversed with a predetermined number or not (a step 305), and in a case of "YES", $O_2$ feedback correction coefficient average value is renewed to A/F leaning value (a step 306).

Figure 9:
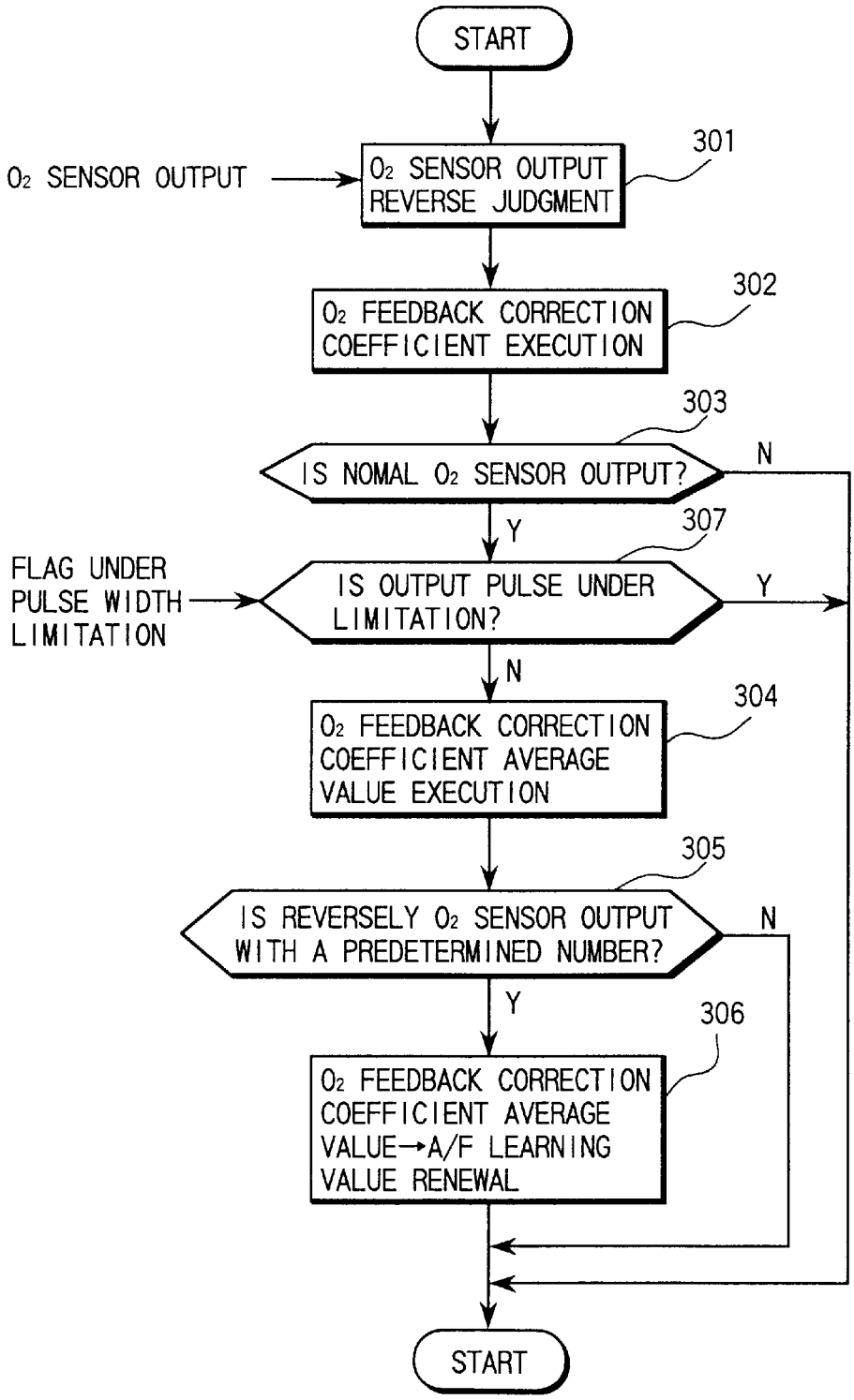
FIG. 9 is a flow chart of the fuel injection control apparatus of one embodiment according to the present invention.
Figure 10:
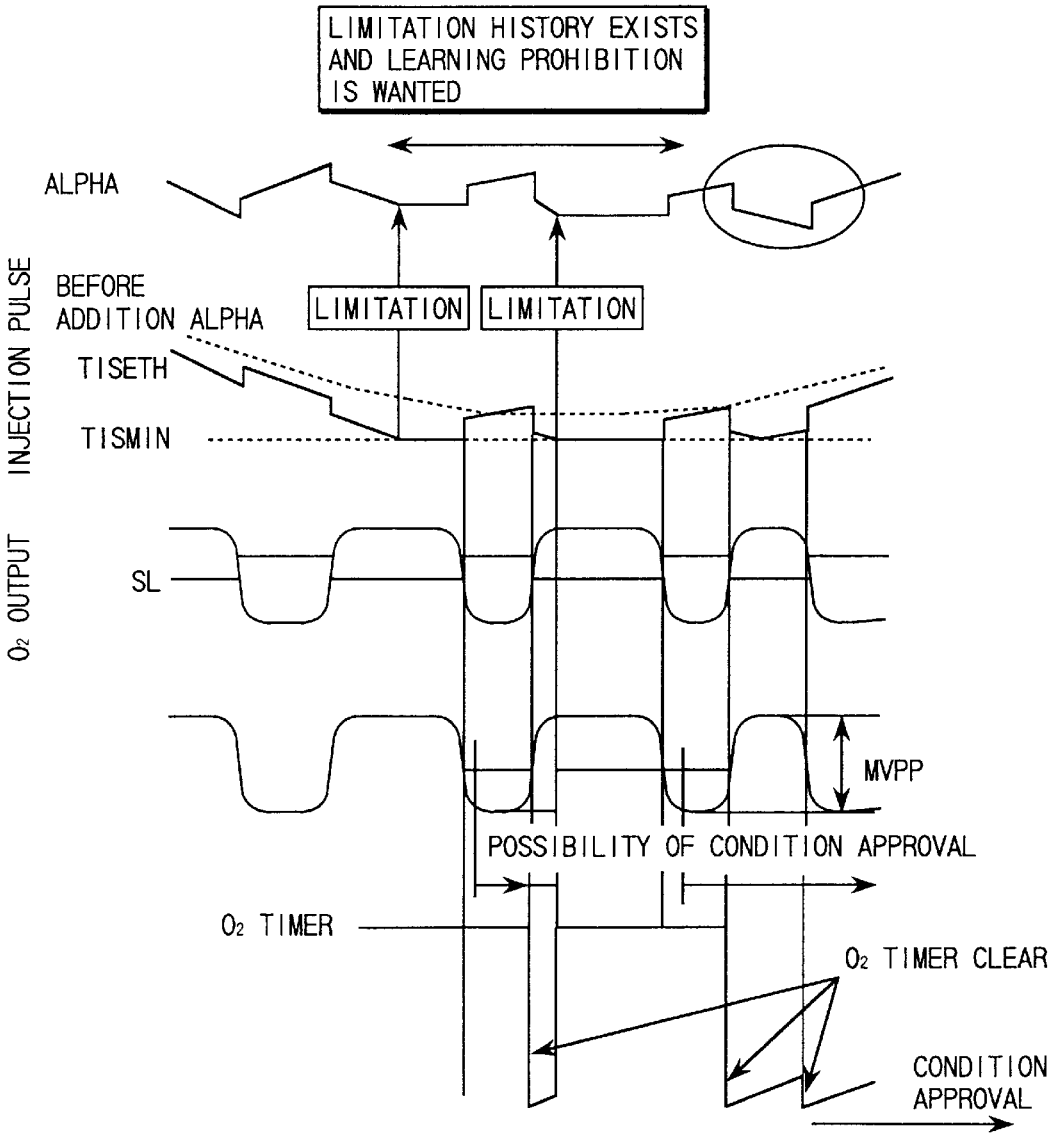
FIG. 10 is another flow chart of the fuel injection control apparatus of one embodiment according to the present invention.

FIG. 9 shows the fuel injection control apparatus of another embodiment according to the present invention. The elements same to in FIG. 8 are denoted the same reference numerals. In FIG. 9, the flag of the pulse value limitation is risen, it is judged that whether the output pulse is during the limitation or not (a step 307) and in a case of "YES", it returns END and a step 306 in which A/F leaning value renewal is carried is skipped. FIG. 10 shows the relationship between the injection pulse, $O_2$ (sensor) output, and A/F learning correction.

Relating to the learning prohibition means under the minimum pulse width limitation, in A/F learning control the deviation is learned during the standard conditions requested under the condition of $O_2$ feedback, and this is learning stored as an error of the air-fuel ratio of the individual. The stored value is reflected in the fuel injection amount which is the operational parameter of the air-fuel ratio. By repeating this operation, the learning value becomes the value for correcting the air-fuel ratio control error of the individual and as a result the control accuracy in the air-fuel ratio can be heightened.

Accordingly, to reflect exactly the air-fuel ratio control error of the individual by the learning value, it is necessary to carry out sound $O_2$ feedback. Herein, in general the renewal of the learning value is carried out, when the parameter used in $O_2$ feedback control is monitored and after that it is judged that the parameter is the sound condition.

For example, $O_2$ sensor detects the air-fuel ratio by the oxygen temperature in the components of the exhaust gas which is the input signal of $O_2$ feedback control and in $O_2$ sensor when the activation is insufficient, the output voltage against the rich condition and the lean condition is smaller than that of after the activation. Further, the responsibility against the oxygen concentration change in the exhaust gas is slower than that of the after activation. Utilizing this phenomenon, in $O_2$ feedback condition, when the change-over of the rich condition and the lean condition is slower dominantly than that of the after activation, the processing for prohibiting not to carry out the learning value renewal according to the result of $O_2$ feedback condition is carried out.

On the other hand, when the limitation of the minimum injection pulse width operates, since $O_2$ feedback control does not function normally, the prohibition of the learning value renewal is the desirable condition. Herein, as to the prohibition of the learning value renewal, following method for prohibiting using the already known learning value renewal prohibition.

The judgment for judging the above stated change-over of the rich condition and the lean condition being slow with the predetermined time is carried out as following, namely the time in which between the output of $O_2$ sensor transits from the high condition of the predetermined voltage to the low condition or from the low condition to the high condition is measured by a timer counter and using the measurement result the judgment is carried out.

Herein, when the limitation of the minimum injection pulse width operates, it established the value for judging whether the timer counter does not carry out the learning value renewal and, in the learning allowance condition judgment at a point where the output of $O_2$ sensor transits from the high condition of the predetermined voltage to the low condition or from the low condition to the high condition, since the non-allowance judgment is done, as a result it is possible to carry out without the renewal of the learning value.

Further, according to this fuel injection method according to the present invention, under the conditions where the operation condition of the engine exists at the vicinity of the minimum injection pulse limitation and repeats the operation and the non-operation of the minimum injection pulse width limitation, the learning value renewal can be prohibited. To consist with the renewal of the learning value, it is necessary to experience the plural times of the change-over of the rich condition and the lean condition, in general it requires several seconds, under the operation history of the minimum injection pulse limitation, it is desirable to prohibit the learning value renewal. And according to the above stated methods, using the timer counter it is effective as the control method to express the history.

In figures, MVPP expresses MAX-MIN output difference of one period of $O_2$ sensor and more than the predetermined value the learning allowance (OK) becomes.

According to the present invention, when the pulse width limitation control is carried out, since the air-fuel feedback correction control such as $O_2$ feedback or A/F learning correction control can be prohibited or limited, when it moves other operation conditions, it invites the excess operation condition such as the over-lean, as a result there is no afraid that the operability is damaged. Further, in company with this the suitable fuel injection can be carried out.

What is claimed is:

1. In a fuel injection control apparatus having an operation condition detection means for detecting an engine operation condition, a fuel injection amount establishment means for establishing a fuel injection amount to an engine according to said detected engine operation condition, and an air-fuel ratio feedback correction means for correcting said fuel injection pulse width according to an air-fuel ratio feedback correction, the fuel injection control apparatus further comprising a pulse width lower limitation establishment means for establishing a pulse width lower limitation value, and a control means for carrying out a control which limits a pulse width correction alternation command according to said air-fuel ratio feedback correction means, said fuel injection pulse width being corrected according to said air-fuel ratio feedback correction, when said pulse width lower limitation value control is carried out.

2. A fuel injection control apparatus according to claim 1, wherein said control means includes to open control of said air-fuel ratio feedback correction means.

3. In a fuel injection control apparatus having an operation condition detection means for detecting an engine operation condition, a fuel injection amount establishment means for establishing a fuel injection amount to an engine according to said detected engine operation-condition, and an air-fuel ratio feedback correction means for correcting said fuel injection pulse width according to an air-fuel ratio feedback correction, the fuel injection control apparatus further includes wherein, a pulse width limitation establishment means for establishing a pulse width limitation value, and a control means for carrying out a control which limits a pulse width correction alternation command according to said air-fuel ratio feedback correction means, under a condition in which said pulse width limitation is carried out.

4. In a fuel injection control apparatus having an operation condition detection means for detecting an engine operation condition, a fuel injection amount establishment means for establishing a fuel injection amount to an engine according to said detected engine operation condition, an air-fuel ratio feedback correction means for correcting said fuel injection pulse width according to an air-fuel feedback ratio correction, and an A/F (air-fuel) learning correction means for A/F learning correcting said fuel injection width according to the A/F learning, the fuel injection control apparatus further includes a pulse width lower limitation establishment means for establishing a pulse width lower limitation value, and a correction width limitation means for limiting the correction, when a calculated fuel injection pulse width according to said air-fuel ratio feedback correction and said A/F learning correction exceeds said pulse width lower limitation value.

5. In a fuel injection control apparatus having an operation condition detection means for detecting an engine operation condition, a fuel injection amount establishment means for establishing a fuel injection amount to an engine according to said detected engine operation condition, an injection pulse width establishment means for establishing a fuel injection width according to said established fuel injection amount, and an A/F (an air-fuel ratio) learning correction means for A/F learning correcting said fuel injection pulse width according to an A/F learning, the fuel injection control apparatus further includes wherein, a pulse width limitation establishment means for establishing a pulse width limitation value, and means for limiting a renewal of the A/F learning, when said fuel injection width affected and calculated according to said correction of said A/F learning correction means exceeds said pulse width lower limitation value.

6. In a fuel injection method, comprising the steps of detecting an engine operation condition, establishing a fuel injection amount to said engine according to said detected operation condition, establishing a fuel injection pulse width according to said established fuel injection amount, carrying out a fuel injection control according to said established fuel injection pulse, effecting a first operation mode for limiting said fuel injection pulse width, and effecting a second operation mode for reopening an air-fuel ratio feedback correction and an A/F learning correction, by using an air-fuel ratio feedback correction coefficient or an A/F learning correction coefficient which are limited at said first operation mode.

* * * * *